United States Patent [19]

Harries

[11] Patent Number: 4,702,206

[45] Date of Patent: Oct. 27, 1987

[54] ROTARY POSITIVE DISPLACEMENT MACHINE

[76] Inventor: John Harries, Flat 15, 30 Oaklands Rd., Bromley, Kent, BR1 3SL, Great Britain

[21] Appl. No.: 852,308

[22] PCT Filed: Jul. 18, 1985

[86] PCT No.: PCT/GB85/00322

§ 371 Date: Mar. 5, 1986

§ 102(e) Date: Mar. 5, 1986

[87] PCT Pub. No.: WO86/00957

PCT Pub. Date: Feb. 13, 1986

[30] Foreign Application Priority Data

Jul. 19, 1984 [GB] United Kingdom ..... 8418373

[51] Int. Cl.[4] ..... F02B 53/00

[52] U.S. Cl. ..... 123/246; 418/206

[58] Field of Search ..... 123/246; 418/206

[56] References Cited

U.S. PATENT DOCUMENTS

| | | | |
|---|---|---|---|
| 1,656,538 | 1/1928 | Smith | 123/246 |
| 3,323,499 | 6/1967 | Gijbeis | 123/246 X |
| 3,709,199 | 1/1973 | Molyneaux | 123/246 |

FOREIGN PATENT DOCUMENTS

| | | | |
|---|---|---|---|
| 656829 | 6/1933 | Fed. Rep. of Germany . | |
| 1703615 | 3/1971 | Fed. Rep. of Germany . | |
| 1289057 | 2/1962 | France . | |
| 1423153 | 11/1965 | France . | |
| 1579908 | 8/1969 | France . | |
| 56-603 | 4/1982 | Japan | 123/246 |
| 429360 | 5/1935 | United Kingdom | 123/246 |
| 587849 | 5/1947 | United Kingdom . | |

*Primary Examiner*—Stephen F. Husar

*Attorney, Agent, or Firm*—Browdy and Neimark

[57] ABSTRACT

A rotary positive displacement machine, and more particularly an internal combustion engine in one of its simplest of many forms, has a housing 1 with inner walls closely surrounding four similar rotors 2,3,4 and 5 arranged in a symmetrical 'square' formation on axles supported by bearings in the housing. Each rotor has evenly spaced lobes and, during rotation, the lobes of neighboring rotors are caused to interlocate, with gearing on the axles maintaining the opposite sense of rotation of such rotors. Chambers are defined between rotors, lobes and housing and, during rotation, working fluid enters through inlet ports 9 and 10 to be carried around to compression regions 21 and 22 from which sections of fluid become transferred between rotors and ignited, thereafter to join expansion regions 25 and 26 before becoming exhausted through outlet ports 11 and 12. The compression ratio so achieved varies and converges to a predictable value.

8 Claims, 10 Drawing Figures

ROTARY POSITIVE DISPLACEMENT MACHINE

FIELD OF THE INVENTION

The invention relates to a rotary positive displacement machine, and more particularly to a rotary internal combustion engine.

The basic design and method of operation of the internal combustion engine is well established, particularly in piston engine form where many reciprocating parts are used. Attempts have been made to design a viable alternative to the piston engine in which the main motion is rotational, or substantially rotational, thereby avoiding or reducing vibration and power losses caused by reciprocation. Other advantages such as weight reduction and simplification of valve operation have also been sought, but ideally not at the expense of certain well established features of the piston engine such as efficient sealing of the combustion chamber, proven reliability and acceptable combinations of torque output and fuel economy. By utilising a method of combustion which involves continuously burning combustion chambers, this invention constitutes an attempt to provide an engine combining pure rotational motion with a simple design and method of operation, thereby gaining the above advantages with the minimum of disadvantages.

SUMMARY OF THE INVENTION

The invention as claimed is intended to provide a means of compression and expansion, applied more particularly to an internal combustion engine, in which all reciprocating motion or eccentric rotation is replaced by pure rotation about fixed axes. In perhaps the simplest of its many forms the rotary engine consists of four similar rotors, each mounted on parallel axles in a symmetrical 'square' formation. Each rotor resembles a cogged or lobed wheel symmetrically mounted on an axle about which it can rotate in the opposite sense to each of two neighbouring rotors and, during rotation, the lobes of such neighbouring rotors mesh, or interlocate, with no contact occuring between lobes, but with each lobe closely approaching or possibly contacting the surface between lobes on the other rotor. The rotation, phasing and consistency of meshing of the rotors is controlled by gearing on the axles and these axles are supported by bearings in the housing which surrounds the rotors on all sides, or substantially so, with close proximity to the swept volume of the rotor lobes. Suitably positioned inlet and outlet ports are set into the housing together with suitably positioned ignition and/or injection devices so that, during rotation, working fluid is caused to be drawn into one of two expanding regions defined between rotors and housing, thence to be carried around to a compression region, subsequently to pass between two rotors and become ignited, thereafter to join an expanding combustion region before being conveyed to one of the outlet regions.

A crucial factor in such a design is that the compression ratio, at the point of maximum compression of the fluid, is not fixed but varies and tends to converge to a value dictated mainly by the shape of the rotors. The advantages offered by the invention are manifold. Firstly, as the motion is rotational and unfluctuating for a given engine speed, the power losses due to reciprocation are eliminated. Also the motion is perfectly balanced, and the rotational motion, coupled with a total absence of valve gear, should provide for smooth operation. Ignition may be simplified to glow plugs so situated that each compressed charge is ignited, as it passes the glow plug, either by the plug itself or by a remnant of burning gas from a previous such ignition. Also, when in operation, each combustion chamber burns continuously with frequent replenishment on one side and separation to exhaust on another. This method of combustion, analogous to a steadily burning and well tended coal fire, should provide greater efficiency as well as offering interesting possibilities concerned with exhaust emission control and the employment of lean mixtures for combustion. A wide usable range of revolution speeds is expected due to the smooth operation, the large number of power strokes per revolution and the fact that each cycle is completed in one revolution, not two as in the piston engine. Also the dimensions of such an engine prove to be very compact in relation to the swept capacity, and high power output is expected due to the many gains in efficiency.

BRIEF DESCRIPTION OF THE DRAWINGS

One way of carrying out the invention is described in detail below with reference to drawings which illustrate one specific embodiment, as well as certain possible variations, in which.

DESCRIPTION OF PREFERRED EMBODIMENTS

Figure 1:
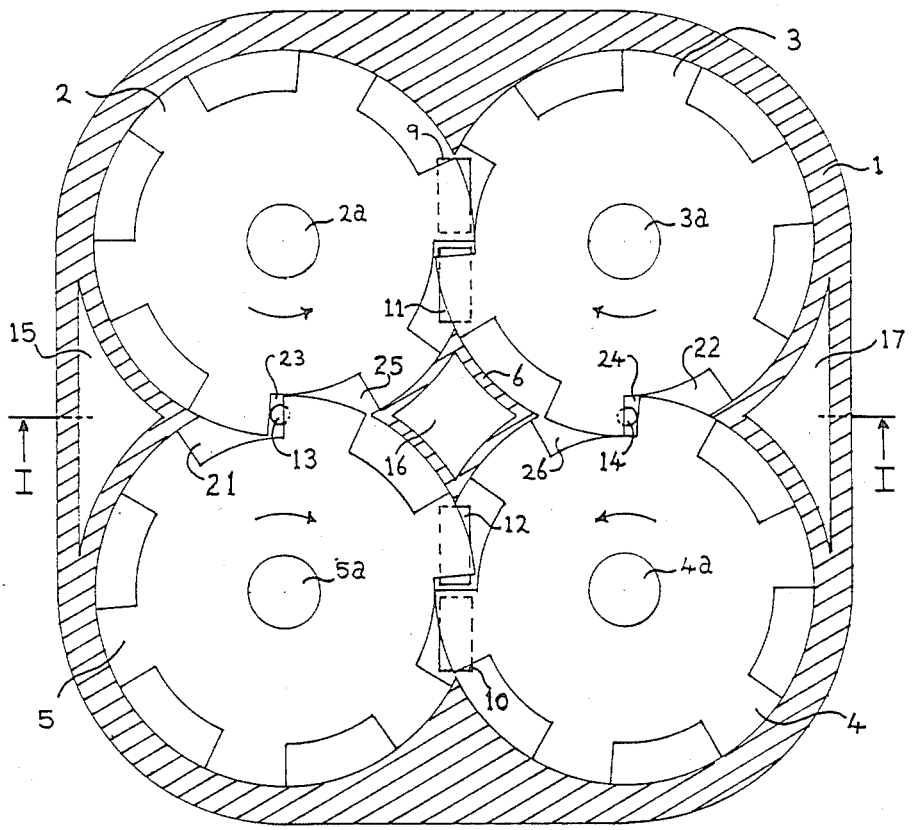
FIG. 1 is a diagrammatic sectional view of a rotary internal combustion engine in accordance with the invention in a direction parallel to the rotor axles, as seen with one side wall of the housing removed.
Figure 2:
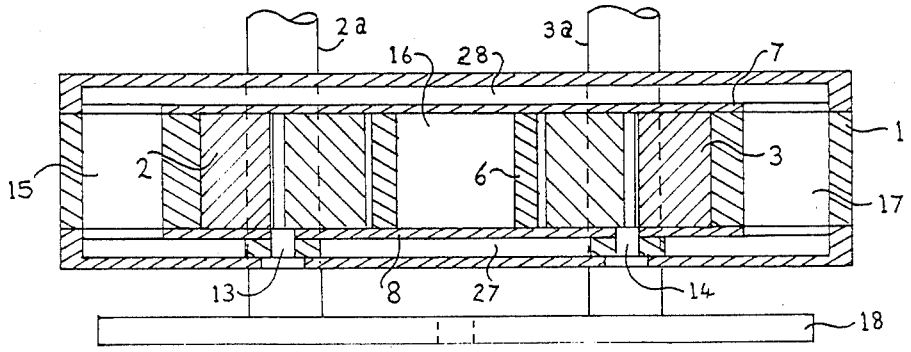
FIG. 2 is a sectional view of the internal combustion engine of FIG. 1 on the plane indicated by the line I—I.

Referring first to FIGS. 1 and 2 of the drawings, an internal combustion engine in accordance with the invention comprises a housing consisting of an outer casing 1, an inner wall 6 and two side walls 7 and 8, in which are mounted four rotors 2,3,4 and 5 each resembling a cogged or lobed wheel, rotatable on parallel axles 2*a*, 3*a*,4*a* and 5*a* which are supported by bearings in the side walls 7 and 8 of the housing. In this preferred embodiment of the design the points at the centres of the axles in FIG. 1 form a square, and the rotors are of similar, or substantially similar, size and shape, their faces perpendicular to the axles being coplanar, and the lobes being uniformly spaced around each rotor, there being six lobes on each rotor in this example. During operation adjacent rotors are constrained to rotate in opposite senses but with the same angular speed so that lobes of adjacent rotors mesh or interlocate with no contact, or minimal contact, occuring between lobes, and in such a way that a lobe of one rotor fits symmetrically in the gap between two lobes of a neighbouring rotor at the central position of the meshing region, with close proximity or near to rolling contact in this region, the motion being maintained by suitable gearing 18 which may be external to, or in another compartment of, the housing. This same gearing may be used to allow for power output from the engine, either by using one or more of the axles directly, or by an output shaft suitably geared to these axles.

Cooling fluid compartments or channels such as 15,16,17,27 and 28 are provided within the walls of the housing to enable cooling where it may be required, and also inlet ports 9 and 10 and outlet ports 11 and 12 are situated in suitable positions in the housing adjacent to the appropriate regions, these ports being continually open with no need for any valve gear. Sparking plugs or glow plugs or other suitable ignition devices may be positioned at approximately the points 13 and 14 in either or both of the side walls, or in the case of a compression ignition version of the engine these may be replaced by injection devices. Also, in the case of a fuel injection version of the engine, both injection and ignition devices may be present with injection possibly occuring slightly before ignition.

When the rotors rotate with, in FIG. 1, rotors 3 and 5 rotating clockwise and rotors 2 and 4 rotating anticlockwise, the combustible mixture, or air in the designs where subsequent injection is involved, is drawn in through the inlet ports 9 and 10 to be carried around with the rotors before becoming compressed in either of the two regions of varying shape 21 and 22. Subsequently, at approximately positions 23 and 24, a section of the compressed gas becomes separated from the compression region and is ignited, and the expansion of burning gases, due to a sequence of such ignitions, continues in regions 25 and 26 before the gases are exhausted through the outlet ports 11 and 12.

Figure 3:
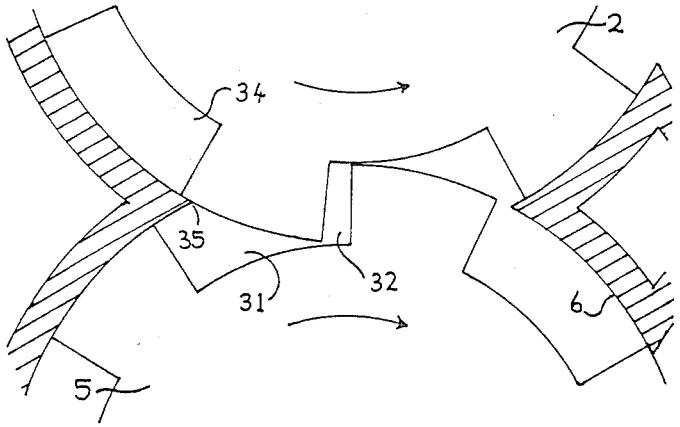
FIGS. 3 to 7 are diagrammatic views of part of the internal combustion engine of FIGS. 1 and 2 showing part of the sequence of rotation of the rotors, FIGS. 8 to 10 indicate some other possible configurations and variations of the design within the scope of the invention.

FIGS. 3 to 7 show part of the working cycle of the internal combustion engine of FIGS. 1 and 2, concentrating on the compression, ignition and expansion sequence, with rotor 2 rotating anticlockwise and rotor 5 rotating clockwise. In the position shown in FIG. 3 the gases in regions 31 and 32 have just been effectively separated and the gases in regions 34 and 31 are about to be combined into a single region by the opening of the gap at 35 during subsequent rotation. Just before this combination occurs it would normally be expected that the pressure of the gas in chamber 34 would be near to atmospheric pressure, and the pressure and corresponding density of the gas in chamber 31 would be higher, and it will be shown that as rotation continues the pressure and density in chamber 31, at the position as shown in FIG. 3, will tend to converge to certain values, these values being predictable and calculable to a high degree of accuracy, with some variation being possible depending on existing conditions and other factors.

Figure 4:
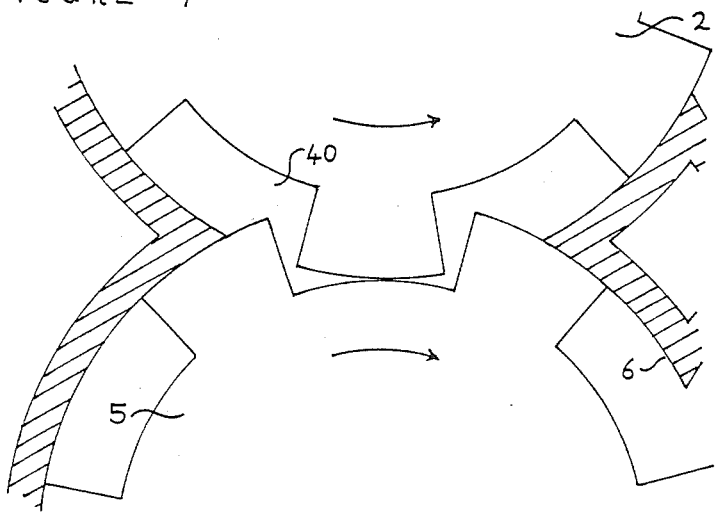
Figure 5:
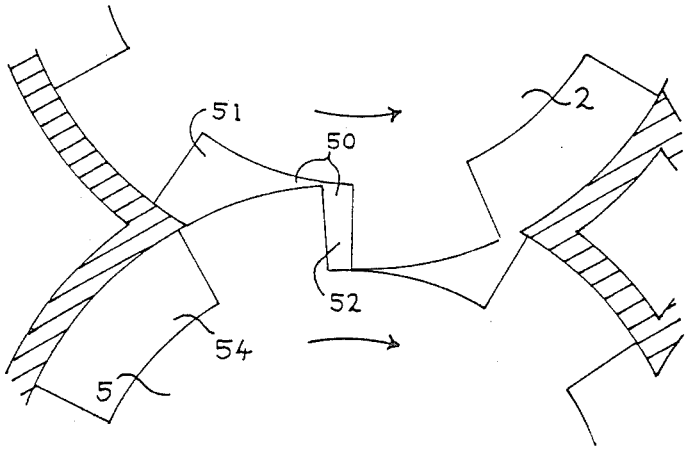
Figure 6:
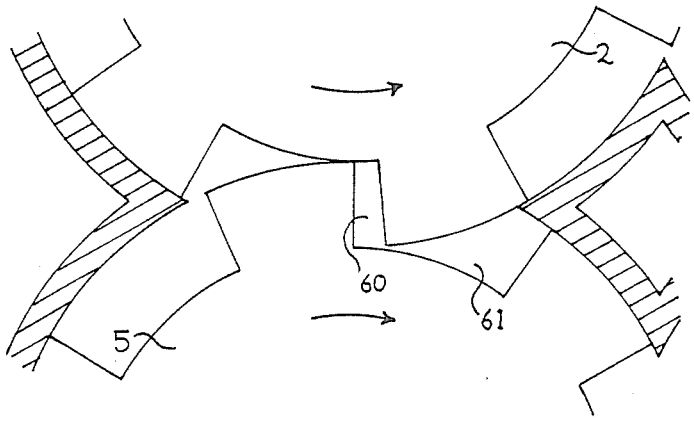
Figure 7:
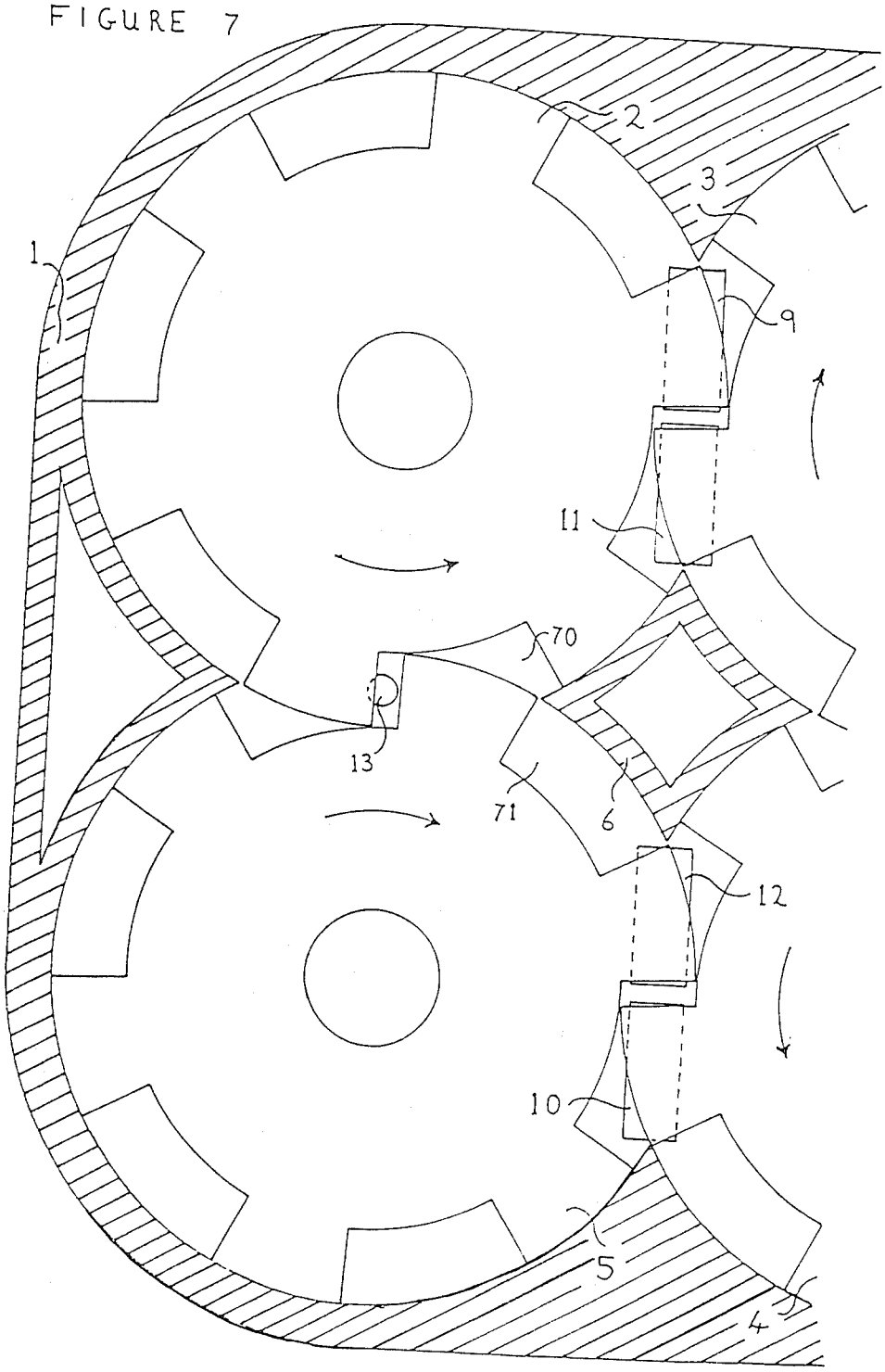

In FIG. 4 the two gases of chambers 34 and 31 of FIG. 3 have combined and compression of this combined volume of gas 40 has commenced. Subsequently, as shown in FIG. 5, the compressed gas of region 40 of FIG. 4 has been further compressed into a region 50 and is on the point of being effectively separated into two regions 51 and 52 by close proximity or contact between rotors, and also in FIG. 5 the regions 54 and 51 are about to be combined into a single region in a similar manner to that described in reference to FIG. 3. The gas in chamber 52 is now near the point of maximum compression and at about this point ignition takes place and the gas expands due to combustion as rotation continues. In FIG. 6 the burning gas in region 60 is on the point of combining with already burning gases in region 61, this combustion region having been created by one or more previous ignitions. The combined volume of burning gas now continues to expand, doing work on the rotors and thence providing the motive force as it does so, until the situation as shown in FIG. 7 is reached where the gas is on the point of being effectively separated into regions 70 and 71, the volume in region 71 being subsequently exhausted through port 12, and the volume in region 70 being about to combine with a newly ignited charge in a manner similar to that described in reference to FIG. 6.

The cycle continues in this fashion as described above with compression repeatedly occuring in regions 21 and 22 of FIG. 1 and combustion repeatedly or continuously taking place in regions 25 and 26, and a similar cycle occurs for all rotors.

Although the engine described above operates on the familiar principle of compression, ignition and expansion, it is the way in which the compression and expansion of the gas is achieved which differs from the method used in the piston engine, and it can be justified mathematically by methods as outlined below, in which, of course, certain assumptions about consistent or ideal conditions have to be made.

Let the density of the gas in its uncompressed or input form as held, for example, in chamber 34 of FIG. 3 be d , measured in some suitable units, and let the density of the two chambers 31 and 32 of FIG. 3 which are at about the point of separation be $d_n$ where the subscript n corresponds to the situation after the n'th ignition, for this rotor pair, since the engine was started. Let the volumes of these two chambers 31 and 32 at this instant of separation be $v_2$ and $v_3$ respectively, and let the volume in chamber 34 be $v_1$.

The mass of gas in chamber 31 is $v_2 \cdot d_n$ and the mass of gas in chamber 34 is $v_1 \cdot d$, and when subsequently these volumes combine as the gap 35 opens during rotation of the rotors the total mass of gas will be $v_1 \cdot d + v_2 \cdot d_n$.

Subsequently the position shown in FIG. 5 will be reached when this same mass of gas will be compressed into a volume of $v_2 + v_3$ at the point where separation occurs between chambers 51 and 52, and the density at this point is $d_{n+1}$.

Hence the mass of the gas in chambers 51 and 52 is given by $(v_2 + v_3) \cdot d_{n+1}$, and it follows that $$(v_2 + v_3) \cdot d_{n+1} = v_1 \cdot d + v_2 \cdot d_n \quad (1).$$

It can be seen that if $d_n$ and $d_{n+1}$ are ever equal, as may be expected to a high level of accuracy when the engine has been running for an appreciable time and n is large, then equation (1) becomes $$(v_2 + v_3) \cdot d_n = v_1 \cdot d + v_2 \cdot d_n$$

$$v_2 \cdot d_n + v_3 \cdot d_n = v_1 \cdot d + v_2 \cdot d_n$$

$$v_3 \cdot d_n = v_1 \cdot d$$

$$d_n = d \cdot (v_1 / v_3)$$

In general let the actual value of $d_n$ be given by $d_n = d \cdot (v_1/v_3) - e_n$, where $e_n$ may be regarded as an error term. Hence equation (1) becomes $$(v_2 + v_3) \cdot \left( \frac{v_1}{v_3} \cdot d - e_{n+1} \right) = v_1 \cdot d + v_2 \cdot \left( \frac{v_1}{v_3} \cdot d - e_n \right)$$

$$\therefore \frac{v_1 \cdot v_2 \cdot d}{v_3} + v_1 \cdot d - (v_2 + v_3) \cdot e_{n+1} =$$

-continued $$v_1 \cdot d + \frac{v_1 \cdot v_2 \cdot d}{v_3} - v_2 \cdot e_n$$

$$\therefore e_{n+1} = e_n \cdot \left( \frac{v_2}{v_2 + v_3} \right) .$$

The quantity $v_2/(v_2+v_3)$ has a value in the region of 0.8 for the configuration of the engine suggested in the example, and it can be seen that as n increases the error term $e_n$ tends towards zero.

If $d_0$ is the density in chamber 31 of FIG. 3 when the first ignition is about to occur, and $e_0$ is the corresponding error term, then after n such ignitions for this pair of rotors, $$e_n = e_{n-1} \cdot \left( \frac{v_2}{v_2 + v_3} \right) =$$

$$e_{n-2} \cdot \left( \frac{v_2}{v_2 + v_3} \right)^2 = \ldots = e_0 \cdot \left( \frac{v_2}{v_2 + v_3} \right)^n \text{ and}$$

$$d_n = \left( \frac{v_1}{v_3} \right) \cdot d - e_0 \cdot \left( \frac{v_2}{v_2 + v_3} \right)^n .$$

When n is large the term $$e_0 \cdot \left( \frac{v_2}{v_2 + v_3} \right)^n$$

is negligible and $d_n \approx (v_1/v_3) \cdot d$, the accuracy being very good as n increases.

In practice $v_1/v_3$ may be regarded as the compression ratio of the engine at the point shown in FIG. 3, but the volume of the compressed gas in chamber 32 will be further compressed by a small amount to give the true compression ratio of the engine. Also, when starting, the compression ratio may need to be 'pumped up' before ignition will occur, but the same mathematical argument will apply.

Similarly on the expansion side, when a substantially steady state has been reached, each compressed and ignited charge of volume $v_3$ combines with a burning and partly expanded volune of gas $v_2$, and this combined volume mixes and expands into a volume: $v_1+v_2$ in a similar state. The expansion of rhe compressed charge to this position therefore has an expansion ratio of $v_1/v_3$, the same as the compression ratio, and it can be seen that each section of gas achieves the same expansion in combustion as in a piston engine of similar compression ratio. Equally it can be shown that the work done by the expansion of each compressed charge corresponds to the value for a piston engine cylinder of similar compression ratio and capacity, despite the fact that in this design successive charges merge during combustion. Also the work done in compression has a value which corresponds to that of a piston engine cylinder of similar capacity and compression ratio.

The above mathematics indicates the general behaviour of the engine whilst running, assuming perfect conditions, and of course in practice there will be variations caused by various factors such as temperature change, seepage between chambers and density variation at input, but nevertheless the general tendency will be for the engine to operate in a substantially steady state with a compression ratio which remains substantially constant.

Figure 9:
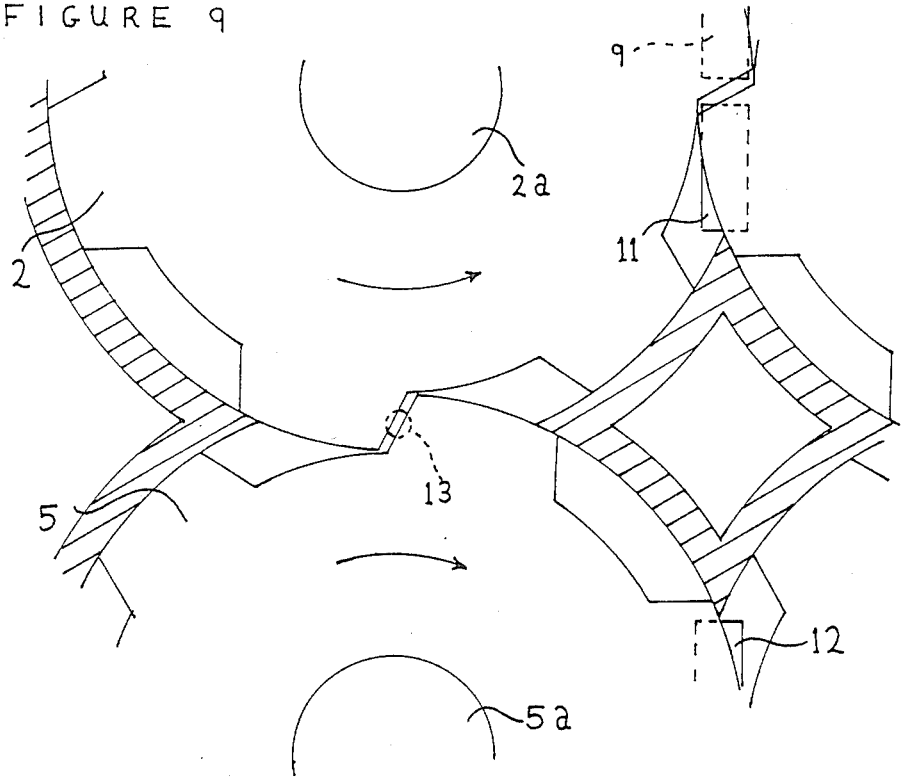

It is of course possible for various modifications to be made to the above described embodiment without departing from the scope of the invention. For example, the rotary internal combustion engine so described could be made to operate on the compression ignition cycle with air being input and injection occuring at approximately the positions 13 and 14 of FIG. 1. In this case the compression ratio would need to be higher than that shown in the example, and it may be necessary to pre-compress the air before input or to so shape the lobes of the rotors so that the higher compression ratio is achieved without clashing occuring between rotor lobes, as shown in a possible configuration in FIG. 9.

Another possibility is to use fuel injection in conjunction with ignition by glow plugs or other suitable means. This would require injection occuring at some point adjacent to an induction or compression region with ignition occuring at approximately the positions 13 and 14 of FIG. 1. Also a machine consisting of at least two rotors, such as rotors 2 and 3 with a suitable housing around them, could operate as a pump or a compressor.

Whether the rotary machine of the invention is used as an engine or as a pump there are also many possible variations in the design which do not detract from the general mode of operation of the machine or from the scope of the invention. There could, for example, be a different number of rotors other than four, or the rotors could rotate in the opposite directions to the way in which they rotate in the example with inlet and outlet ports switching roles, or the number of lobes on each rotor may be varied from the six shown in the example. Also the shape of the rotors, their lobes and the housing around them may take many forms, with possible variations in the number, style and positioning of such items as the inlet and outlet ports, ignition devices, injection devices, cooling chambers and bearings. It may, for example, be thought advantageous to position the inlet and outlet ports in opposite walls of the housing, possibly with a slight overlap to allow for scavenging of the exhaust gases. Equally, there may be justification in using a plurality of ports for any input or output region, possibly using ports set into walls 1 and 6 near appropriate regions. It is also possible to design a configuration of the rotary machine of the invention in which the axles are more generally positioned relative to each other than in the symmetrical form of the example, or in which the axles are not parallel, or in which rotors of different shapes and sizes are used in the same design.

Figure 8:
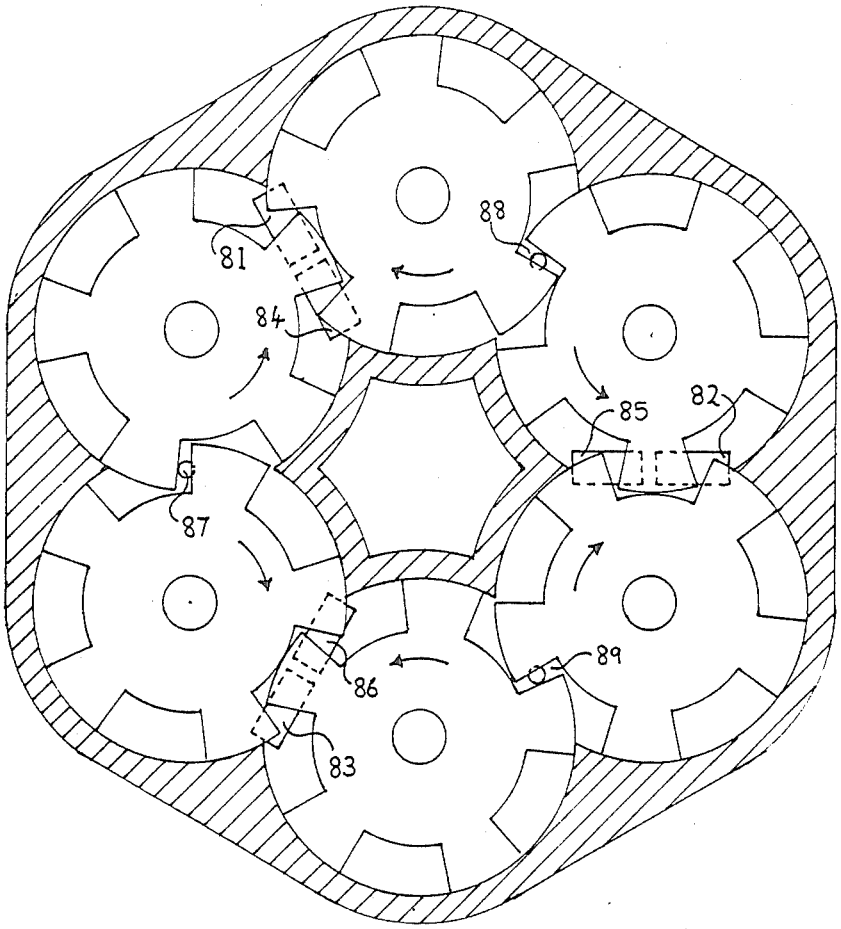

FIG. 8 shows an alternative configuration of an internal combustion engine in accordance with the invention in which six rotors are used, there being five lobes on each rotor, and in this Figure there are three inlet ports 81,82 and 83 and three outlet ports 84,85 and 86, ignition taking place at approximately the positions 87,88 and 89, and the general mode of operation being similar to the example described.

Many other features of the machine can take different forms, and much will depend upon development. Cooling may be achieved by pumping water or other suitable fluid through chambers in the housing, but alternatively air cooling may be employed, perhaps using the action of the rotors to pass air around or through the engine, using gaps in the housing and/or the rotors.

Figure 10:
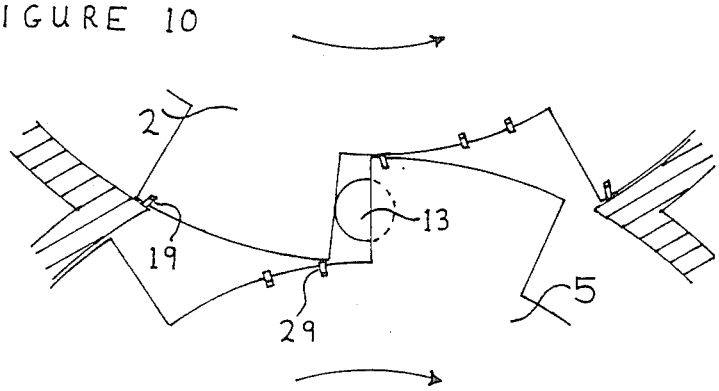

The pure rotational motion of the design will permit precision engineering, with a very narrow gap being possible between rotors and housing, particularly near the compression and expansion regions, and similarly the rotors could have a near to rolling contact at their point of nearest approach. If the rotors, gears and housing are made of similar material, expansion due to heat generation should be largely uniform, again permitting close tolerances to be held over a range of operating temperatures. As such, the use of seals may not be necessary, but if desired they may be incorporated in various positions in the housing and/or the rotors so as to assist in separation of regions. FIG. 10 illustrates one way of achieving this with seals such as 19 and 29. Such seals may be spring loaded or flexible and, if the rotor lobes are shaped to resemble sections of a torus, it may be possible to use piston ring technology.

Lubrication may be achieved in many ways, possibly using oil spread and distributed by the rotating action of the rotors and gears, or alternatively oil could be input with the fuel. Ihe presence of a film of oil or other lubricant on the rotors and walls of the housing may also assist with segregation of the gas regions, further reducing the need for seals.

When in the form of an internal combustion engine many ancillary devices may be necessary or desirable, depending on particular requirements. The design readily lends itself to supercharging or turbocharging, particularly as the flow of gases in and out of the engine is substantially steady, and naturally the input of air or combustible mixture at higher than atmospheric pressure would merely increase the effective compression ratio of the engine without departing from the basic concept of the design. As mentioned before, carburation or fuel injection may be used, possibly allowing for simplified designs in each case due to the continuous flow of gases. Injection, for example, could be occuring continuously into the compression regions 21 and 22 of FIG. 1, thereby obviating the need for timing of an intermittently operating injector. Also the ignition system may be simplified to a constantly lit glow plug with no timing being required. Other ancillary devices such as altenator, starter motor, cooling fan, battery and general electrical system would be incorporated as required.

In one of its many possible forms, a rotary engine in accordance with the invention would have many advantages over a piston engine. In the example previously described there would be 24 power strokes per revolution of the rotors, these occuring in 12 virtually simultaneous pairs, and hence there would be a firing rate similar to that of a 24 cylinder piston engine. The main motion, that of the rotors, would be purely rotational about fixed axes, and the rotation of each rotor would be at constant angular speed for a given rotational speed of the output shaft. Also inlet and exhaust gases would flow at substantially steady rates for a given speed of rotation. There would be no reciprocating parts nor any valve gear to operate, and these factors combined with those given above should provide an engine of high reliability, smooth operation and a very wide usable range of revolution speeds.

Ignition, when utilising a glow plug system, should be greatly simplified. A remnant of burning gas would remain, after each ignition, within a cavity in which the glow plug could be set, and this would ignite the following compressed charge. Such ignition by contact with a burning gas should virtually eliminate the delay period of ignition which causes complications in a piston engine. Also the nature of the motion, combustion and expansion would allow for continuously burning combustion regions, with no timing being necessary, the action being self perpetuating.

Finally such an engine would be considerably smaller and lighter than a piston engine of similar swept capacity.

What is claimed is:

1. A rotary internal combustion engine comprising a casing with intersecting rotor compartments, rotors able to rotate in said compartments and turning about axles which are supported by the casing, each said rotor being in the shape of a disc with abutments or lobes defined between alternating tips and roots with respective outer and inner radii, gearing on the axles controlling said rotors to rotate without contact of respective interleaving lobes in such a way that interior surfaces of said casing and opposing tips and roots of first alternating adjacent pairs of said rotors define a transfer volume between separated compression and expansion regions on respective sides of a plane through axes of said rotors of each said first adjacent pair, apertures in the casing to permit output and input of working fluid or gases from and to said compression and expansion regions under the action of the other adjacent interacting rotor pairs, each said first alternating adjacent pair of interleaving rotors providing a periodic transfer of a respective volume of the fluid or gas between the respective compression region via the transfer volume to the respective expansion region, and means for igniting the working fluid or gas in said transfer volume between the respective compression and expansion regions, wherein the peripheral length of each said tip is shorter than the respective peripheral length of each opposing root, said transfer volume is defined to extend between respective opposing sides of said abutments or lobes of the respective first interleaving rotor pair when said interleaving lobes are equally spaced from said plane of the respective first rotor pair, respective opposing tips and roots of each said first rotor pair have a point of closest contact in said plane thereof, and each said transfer volume contains a part of the working fluid or gas from the respective compression region that is sectioned off as a result of the respective interleaving rotors, which part expands into the respective expansion region, as the rotor rotates.

2. The engine of claim 1, in which there are four of said rotors, each of similar shape and with evenly spaced abutments, so arranged to permit regular angular phasing of the interleaving abutments for each interacting rotor pair.

3. The engine of claim 2, in which the successive compression ratios of the transfer volumes when separating from a compression region form a sequence which converges to the ratio of the volume of the chamber defined two adjacent abutments of one rotor just before entering the compression region to the transfer volume at separation from the compression region.

4. The engine of claim 1, in which said means for igniting the fluid or gas are sparking plugs or glow plugs set into the casing in positions suitable to ignite the transfer volumes.

5. The engine of claim 1, comprising further means for injecting fuel into each compression or transfer region to create a combustible mixture.

6. The engine of claim 1, comprising six of said rotors, each said rotor having five lobes.

7. The engine of claim 1, wherein an upper limit for the compression ratio is given by the ratio of a first volume, defined between two adjacent lobes of the same rotor and a wall of said casing past which said lobes move, and a second volume, defined between first and second lobes on respective first and second ones of said rotors forming one of said interacting rotor pair, said first rotor being ahead of said second rotor, and said first and second volumes being determined at a separation point, namely just prior to said second lobe of said second rotor rotating past a final part of said wall of the casing.

8. The engine of claim 2, comprising six of said lobes on each said rotor.

* * * * *